US005813553A

United States Patent [19]

Herr et al.

[11] Patent Number: 5,813,553

[45] Date of Patent: Sep. 29, 1998

[54] SNAP-BAND TAMPER EVIDENT

[75] Inventors: James E. Herr, East Petersburg; Henry H. Nyman, Jr., York, both of Pa.

[73] Assignee: Kerr Group, Inc., Lancaster, Pa.

[21] Appl. No.: 951,379

[22] Filed: Oct. 16, 1997

Related U.S. Application Data

[63] Continuation of Ser. No. 487,308, Jun. 7, 1995, abandoned.

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 2,153,427 | 4/1939 | Fleisch et al. . | |
| 2,153,428 | 4/1939 | Kosar . | |
| 2,950,832 | 8/1960 | Brune . | |
| 3,950,917 | 4/1976 | Choksi et al. . | |
| 4,337,869 | 7/1982 | Guinle . | |
| 4,432,461 | 2/1984 | Mumford et al. . | |
| 4,457,438 | 7/1984 | Varlet et al. . | |
| 4,487,324 | 12/1984 | Ostrowsky . | |
| 4,493,427 | 1/1985 | Wolkonsky | 215/230 |
| 4,506,795 | 3/1985 | Herr . | |
| 4,511,053 | 4/1985 | Brandes et al. . | |
| 4,511,054 | 4/1985 | Shank . | |
| 4,512,485 | 4/1985 | Agbay et al. . | |
| 4,530,437 | 7/1985 | Gray et al. . | |
| 4,537,319 | 8/1985 | Whitney . | |
| 4,550,844 | 11/1985 | Lininger | 215/252 |
| 4,595,547 | 6/1986 | Herr . | |
| 4,598,833 | 7/1986 | Herr . | |
| 4,625,875 | 12/1986 | Carr et al. . | |
| 4,643,321 | 2/1987 | Gach . | |
| 4,679,696 | 7/1987 | Bonnenfant et al. | 215/252 |
| 4,694,970 | 9/1987 | Hayes . | |
| 4,748,735 | 6/1988 | Hayes . | |
| 4,749,095 | 6/1988 | Rote . | |
| 4,775,064 | 10/1988 | Baxter | 215/230 |
| 4,801,030 | 1/1989 | Barriac | 215/252 |
| 4,801,031 | 1/1989 | Barriac . | |
| 4,807,771 | 2/1989 | Roy et al. . | |
| 4,860,907 | 8/1989 | Sondal . | |
| 4,875,594 | 10/1989 | Ochs . | |
| 4,909,404 | 3/1990 | Rozenberg . | |
| 4,919,285 | 4/1990 | Roof et al. . | |
| 4,936,474 | 6/1990 | Szczesniak et al. . | |
| 4,989,740 | 2/1991 | Vercillo . | |
| 5,027,964 | 7/1991 | Banich, Sr. . | |
| 5,076,453 | 12/1991 | Odet | 215/252 |
| 5,103,991 | 4/1992 | Collins . | |
| 5,145,078 | 9/1992 | Hannon et al. . | |
| 5,190,177 | 3/1993 | Collins . | |
| 5,213,223 | 5/1993 | Minnette . | |
| 5,213,224 | 5/1993 | Luch . | |
| 5,219,084 | 6/1993 | King . | |
| 5,271,512 | 12/1993 | Ekkert . | |
| 5,328,044 | 7/1994 | Röhrs et al. . | |
| 5,356,019 | 10/1994 | Kelly . | |
| 5,397,009 | 3/1995 | Salmon et al. . | |

(List continued on next page.)

FOREIGN PATENT DOCUMENTS

| | | | |
|---|---|---|---|
| 034 997 | 2/1981 | European Pat. Off. . | |
| 86970 | 8/1983 | European Pat. Off. | 215/252 |
| 2 290 364 | 12/1976 | France . | |
| 2 291 915 | 12/1976 | France . | |
| 27 00 322 | 7/1978 | Germany . | |
| 3722603 | 7/1988 | Germany | 215/252 |

*Primary Examiner*—Stephen Cronin
*Attorney, Agent, or Firm*—Kenyon & kenyon

[57] ABSTRACT

A threaded closure is provided with a snap-fit ring. A snap-fit tamper-evident band with three concentric portions is provided such that the first portion engages the closure's snap-fit ring and is removed from the rest of the band when the closure is rotated off of the container neck. A second portion includes tabs for engaging, e.g., an annular ring on a container neck. A third portion remains on the container neck when the first portion and the cap are rotated off. A number of frangible posts are also provided for connecting the first portion to the second and third portions.

7 Claims, 2 Drawing Sheets

U.S. PATENT DOCUMENTS 5,433,331 7/1995 Morini .
5,465,858 11/1995 Gargione .
5,487,481 1/1996 Sander et al. .
5,488,888 2/1996 Kowal .
5,501,349 3/1996 McCandless .
5,564,582 10/1996 Kamath .
5,590,799 1/1997 King .
5,609,262 3/1997 Trout .
5,609,263 3/1997 Perchepied .
5,611,443 3/1997 King .
5,660,288 8/1997 Nyman, Jr. .

1

SNAP-BAND TAMPER EVIDENT

This application is a continuation of application Ser. No. 08/487,308, filed on Jun. 7, 1995 now abandoned.

FIELD OF THE INVENTION

The present invention includes a threaded closure with a snap-fit ring. A snap-fit tamper-evident band with two concentric portions is provided such that the first portion engages the snap-fit ring and is removed from the rest of the band when the closure is rotated off of the container neck. A second portion has tabs for engaging, e.g., an annular ring on a container neck. This second portion remains on the container neck when the first portion and the cap are rotated off. A number of frangible posts are also provided for connecting the first portion to the second portion.

BACKGROUND OF THE INVENTION

The importance of providing tamper-evident features on bottles and other containers is well known. Consumers have increasingly come to expect bottles and containers of all types that contain substances for ingestion to be equipped with a tamper evident feature. Although the use of such closures is widespread, the expense involved in producing such tamper evident containers has had a limiting effect on their use. If such closures could be manufactured more inexpensively than at present, they would be more widely used.

One approach to providing a tamper evident closure is to use a shrink wrap about the container and closure. This approach does not require the closure itself to have a tamper evident feature. In order to access the contents of the container, the shrink wrap must be punctured or torn, which leaves a visible indication that the container has been accessed and perhaps tampered with. A related approach is to apply a band of tamper-evident tape about the circumference of the junction between the closure and the container. Unfortunately, each of these approaches requires that the shrink wrap or tape be provided by an additional piece of machinery through a secondary manufacturing operation after the container has been filled. The capital machinery necessary to perform these steps is often expensive, which has impeded the acceptance of this approach.

In another approach, the closures themselves are made to be inherently tamper evident. Once manufactured, such closures need not require the additional assembly steps that the application of tape or shrink wrap require.

For example, U.S. Pat. No. 4,989,740, issued Feb. 5, 1991, describes a closure with a shell 12 that closes a container. An overcap 54 is provided over the shell which engages the shell at a curl 52. The overcap further has a tamper-evident band 66.

U.S. Pat. No. 3,950,917, issued Apr. 20, 1976, describes a closure with a threaded inner cap 10, an internally splined and externally threaded outer cap 15 with a frangible brim 18, and a "jacking ring" 22. Rotation of the jacking ring 22 fractures the outer cap at the frangible brim 18. It should be noted that the technique of keeping brim 18 on the neck is heat fusion.

U.S. Pat. No. 4,909,404, issued Mar. 20, 1990, describes, in the embodiment of FIG. 23, a TE snap-on type closure. In this invention, however, the TE band is integral with the cap.

Finally, U.S. Pat. No. 4,512,485, issued Apr. 23, 1985, and U.S. Pat. No. 5,213,223, issued May 25, 1993, each describe, to a certain extent, intermediate closure members.

Unfortunately, such caps with complicated tamper evident structures are often difficult to manufacture, and therefore expensive to produce. This is an important consideration, for the competitive pressures present in the field of packaging often confer a market advantage on those who use the least expensive packaging scheme. Furthermore, approaches that use tear-away pieces often generate sharp edges and additional litter, with the attendant possibility that the portion that is torn off may fall into the container. These attributes are not acceptable to many consumers.

There remains a need for an inexpensive means of providing a tamper evident seal on containers, which requires neither intricate molding nor extraordinary machinery beyond that routinely used to attach conventional closures to containers.

SUMMARY OF THE INVENTION

The present invention satisfies these needs by providing a tamper-evident cap that is easy to manufacture and simple to incorporate into existing product packaging lines.

The present invention includes a threaded closure with a cap having a snap ring and a snap-fit ring. The snap-fit ring has three concentric portions such that the first portion, a snap-fit ring, engages a cap ring. The second portion, a tamper-evident band, is removed from the snap-fit ring band when the closure is rotated off of the container neck. A third portion has tabs for engaging, e.g., an annular ring on a container neck. The second and third portions remain on the container neck when the first portion and the cap are rotated off. A number of frangible posts are also provided for connecting the first portion to the second and third portions.

The snap-fit ring may have features designed to provide a friction or snap fit with the cap, holding the ring in position for application to a container. The ring can be allowed to slip within the cap, or ring slippage can be preferably prevented through a locking arrangement.

The cap includes a base wall and an annular sidewall integrally joined to the base wall about the periphery of the base wall which depends therefrom. Locking features are also provided for engaging the annular retaining feature to prevent the tamper-evident band from being removed with the cap when the closure is removed from the container. An annular weakened portion is also provided such that at least a portion of the snap-fit ring is frangibly disconnected from the cap when the closure is removed from the container. The cap ring which attaches- to the snap fit ring preferably includes an undercut and retention feature.

The annular retaining feature is preferably an annular ring, and is preferably located adjacent threads on a neck on the container.

The annular weakened areas may be a plurality of perforations or bridges which are formed either in the primary mold or alternatively in a secondary cutting operation. Such methods are shown, e.g., in U.S. Pat. No. 4,506,795 issued to Herr, which is herein incorporated by reference.

Both the inner cap and the tamper evident band are preferably made of a polymer-based plastic.

The locking features may be a plurality of flexible tabs connected to the tamper evident band which are capable of being bent upward and radially inward from the tamper evident band for engaging the annular retaining feature of the container. Such tabs may be formed by heating and softening the point at which they are connected to the closure sidewall, and bending the tabs inwardly and upwardly accordingly. Such a technique is also shown in U.S. Pat. No. 4,506,795, which is incorporated herein by reference. But, preferably, the snap-fit ring will have perforations and tabs molded into their proper positions.

A tamper evident closure and container combination is also provided which has a container having at least one annular retaining feature, as well as the closure described above.

A tamper evident closure for closing a container having at least one annular retaining feature is provided which has a cap having a cap ring for attaching a snap fit ring to the cap. The snap fit ring includes a snap fit band for attaching the snap fit ring to the cap, a tamper evident band, and locking features engaging the annular retaining feature to prevent the tamper evident band from being removed with the cap when the closure is removed from the container. At least one annular weakened area is provided such that at least a portion of the snap fit ring is frangibly disconnected from the cap when the closure is removed from the container.

The cap and container may be threaded. The annular retaining feature is preferably an annular ring, which is located adjacent threads on a neck on the container. The annular weakened area is located either at the junction between the snap fit band and the tamper evident band, or is located at the junction between the snap fit band and the plurality of locking features.

DETAILED DESCRIPTION OF THE INVENTION

Figure 1:
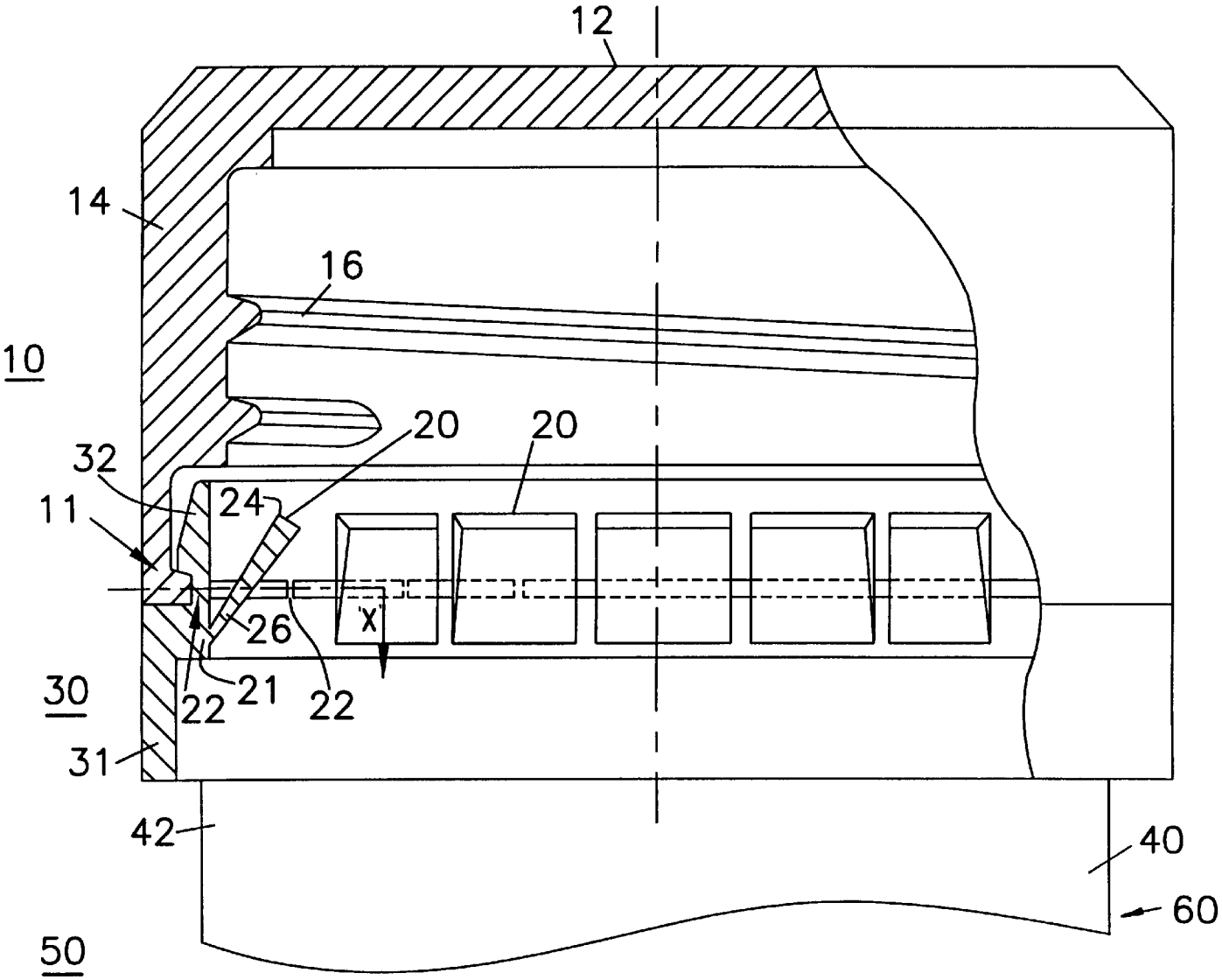
FIG. 1 illustrates a cutaway side view of a closure according to an embodiment of the present invention.
Figure 2:
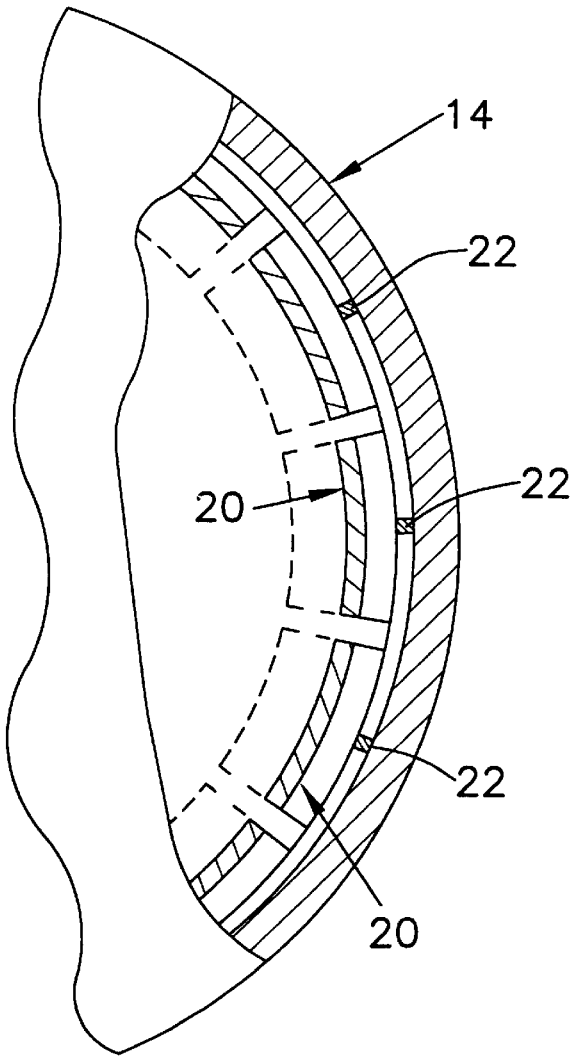
FIG. 2 illustrates a cutaway top view of part of a closure according to an embodiment of the present invention.

An embodiment of the present invention is shown in FIG. 1. In the Figure, closure 1 is formed by the combination of cap 10 and snap fit band 30. Cap 10 is formed by base wall 12 and annular side wall 14. In particular, annular side wall 14 depends circumferentially from base wall 12. In the interior of inner cap 10 may be placed internal threads 16, which are shown in the Figure in a cutaway view. Around the circumference of the base of the sidewall 14 depends cap ring 11.

The closure 1 may be mounted on container 50. In particular, the closure 1 is mounted on neck 40 of container 50, preferably through the use of exterior container threads 42.

Figure 3:
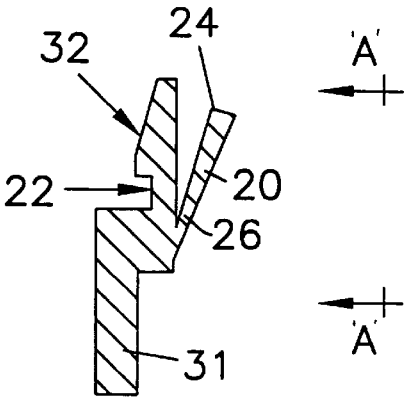
FIG. 3 illustrates a cutaway cross section of a part of the snap fit ring.

Prior to the installation of cap 10 on container 50, snap fit ring 30 is mounted to cap 10. Snap fit ring 30 has three essentially concentric integral features, as shown in FIG. 3. The first is the snap fit band 32. The second is the tamper evident band 31. The third feature is the set of tamper evident tabs 20.

The friction or snap fit holds the ring 30 in position for application to the container 50. The ring 30 may be allowed to slip within the cap 10, or preferably band slippage may be prevented through a locking arrangement. In the locking arrangement shown in FIG. 1, snap fit band 32 frictionally engages cap ring 11 so as to hold snap fit ring 30 onto cap 10.

Depending from the tamper evident band 31 is a series of tabs 20 which are spaced circumferentially from each other. The tabs 20 are capable of being bent upwardly and radially inwardly into the interior of the cap 10 for engaging the annular retaining feature 60 of the container 50. Such tabs 20 may be formed by standard molding techniques. The tabs may be angled upward into closure 1 by heating and softening the connecting point 21 at which they are connected to the snap fit ring 30. The tabs may then be easily bent inwardly and upwardly accordingly. Such a technique is shown in U. S. Pat. No. 4,506,795, which is incorporated herein by reference. Preferably, however, the perforations and tabs are molded into their proper positions when the cap is formed.

FIG. 1 also shows an embodiment of a container 50 of the present invention which shows a neck 40 extending upwardly. The neck 40 has an opening through which the contents of the container 50 may be dispensed. The exterior of the neck 40 has threads 42 which threadingly engage corresponding threads 16 on the interior of the annular side wall 14. Finally, the neck 40 has an annular retention feature 60, which may be an annular ring as shown, which provides a projection against which, e.g., the tabs 20 may push against so as to hold the tamper evident band 31 below the annular ring.

When the closure is used to seal the open mouth of the container 50, the closure is installed by being screw threaded or otherwise placed onto the neck 40 of the container 50.

Prior to the capping operation, the tabs must be flexed inward so that they extend radially and inwardly, pointing towards the interior of the cap 10, as explained above. Preferably, of course, the tabs are molded into this position. Once the tabs are oriented inwardly, the cap 10 may be placed onto the container 50. During this installation procedure, the tabs 20, so oriented, contact the threads 42 that travel over them. The tabs 20 also travel over the annular ring 60. Once past these obstructions, the tabs 20 flex slightly inwardly towards the central axis of the cap 10.

The tabs 20 preferably have a triangular cross-section, as shown in FIG. 1, where the distal and 24 of each tab 20 is thicker than the proximal and 26.

Figure 4:
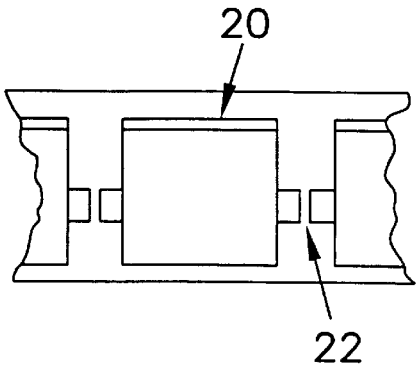
FIG. 4 illustrates a view along lines A—A of FIG. 3.

This orientation of the tabs inhibits upward motion of the cap 10 because the tabs 20 engage the annular retention feature 60 but may not pass back over it. Thus, the tabs 20 hold the tamper evident band 31 onto the container neck 40, which in turn holds the snap fit ring 30 and thus cap 10 onto the container neck 40 via weakened areas 22, as shown in FIG. 4. The triangular cross-section of the tabs 20 has been found to assist in this aspect.

When a user wishes to dispense some or all of the contents of the container 50, the user rotates the cap 10 off of the container 50. This rotational motion is, of course, translated into an upward force by the action of the threads 16 and 42. As the cap 10 is forced upward, tension is exerted on the weakened areas 22 because the upward motion of the cap 10 is countered by the downward force of the tabs 20 against the annular retention feature 60. That is, the tabs 20 keep the tamper evident band 31 at or below the level of the annular retention feature 60, while the user's rotation of the cap 10 forces the cap 10 upward.

After more rotation of the cap 10 and its subsequent upward motion, enough tension is placed on the weakened areas 22 that they rupture and break. This frangible quality of the weakened areas 22 thus allows the cap 10 to be removed from the container neck 40 while leaving in place, under the annular retention feature, the tamper evident band 31 and the tabs 20. The presence of the tamper evident band 31 and tabs 20, separated from the cap 10, thus alerts the user that the closure's seal has been broken and at least one person has gained entry to the contents of the container 50 prior to the proper use by the user. The presence of the tabs 20 also assists in the initial installation of the cap 10 onto the container 50. This is because the inwardly oriented tabs 20 tend to guide the cap 10 onto the container neck 40 during installation, even if the alignment of the cap 10 and the container neck 40 is not exact. In particular, if the alignment is not exact, the tabs 20 tend to push the cap 10 and/or container 50 into alignment.

The cap 10 is provided with a cap ring 11 for attaching the snap fit ring 30 to the cap 10. In particular, while shown in FIG. 1 as a cylindrical ring with an undercut, the cap ring 10 may be, for example, a series of projections, clips, hooks, holes, etc. This cap ring 11 engages the snap fit band 32 on the snap fit ring 30 in order to attach the snap fit ring 30 to the cap ring 11. The snap fit band 32 may be, for example, complementary hooks, holes, projections, tabs, ramps, etc.

In this way, the cap 10 and the snap fit ring 30 may be manufactured separately. Precise control over each of their constructions may be effected and a variety of different closure caps 10 and snap fit rings 30 with tamper evident bands 31 can be matched together for any particular commercial use.

In addition, a variety of exterior caps can be placed on top of the inner cap. These exterior caps can be ribbed, smooth or alternatively configured to accept special decorative or functional overcaps.

The snap fit ring 30 is equipped with locking features which engage an annular retaining feature on the container 50 to prevent the tamper evident band 31 from being removed with the cap 10 when the closure 1 is removed from the container 50. An annular weakened portion is provided via weakened areas 22, such that at least a portion of the tamper evident band 31 is frangibly disconnected from at least a portion of the inner cap 10 when the closure is removed from the container. The annular weakened areas 22 may be a plurality of perforations or bridges which are formed preferably in the primary mold but alternatively in a secondary cutting operation. Such methods are shown, e.g., in U.S. Pat. No. 4,506,795 issued to Herr, which is herein incorporated by reference.

The annular retaining feature preferably takes the form of an annular ring 60. Engaging the annular ring 60 are the locking features on the cap, which preferably take the form of tamper evident tabs 20. The annular weakened areas 22 are located at the junction of the snap fit band 32 and the remainder of the snap fit ring 30, i.e., the combination of the tamper evident band 31 and the tabs 20, and typically comprises a plurality of perforations or bridges.

Once the two-piece tamper evident closure is assembled, it may be used in the following manner. First, the closure assembly is applied to a container 50 in a conventional way, rotating the cap 10 relative to the container neck 40 to engage the typically helical threads 16 and 42. The locking features such as tabs 20 then interface with the container neck 40 and snap over the appropriate retention feature, which is preferably an annular retaining bead or ring 60. Upon the first removal, the closure locking features, which are preferably tamper evident tabs 20, engage the container annular ring 60 and resist removal whereupon the connecting bridges or perforations 22 break. When the connecting bridges or perforations 22 break, the tamper evident indicating band 31 is allowed to drop from the cap 10 to indicate initial opening. The user is thus alerted that the contents of the container 50 may have been accessed.

Such snap-fit tamper evident closure construction provides benefits such as precise control over the formation of the perforations and/or the ring-cap interface. Furthermore, there is an opportunity to use a variety of band materials/colors/decorations for functional or aesthetic reasons. Finally, flexibility of the product line, i.e., the ability to utilize a variety of ring types, or no rings for non-tamper evident applications, is thus afforded.

Of course, it will be recognized by those skilled in the art that the various optional features of the disclosed closure may be combined in any number of ways without departing from the scope of the present invention. In addition, while the invention has been described with respect to a particular snap-fit arrangement, those skilled in the art will recognize that a closure according to the present invention may have a number of different types of snap-fit systems and that the scope of the invention is to be limited only the claims appended hereto and equivalents thereof.

What is claimed is:

1. A tamper evident closure comprising:

(a) a cap having (i) a base wall, (ii) a side wall depending from the base wall to a side wall base, and (iii) a cap ring located at the side wall base and projecting radially inwardly from the sidewall base; and (b) a tamper evident ring which is snap fittingly engaged with the cap, the tamper evident ring comprising:

(i) a snap fit band comprising a tab constructed to slide past the cap ring when the tamper evident ring is snap fit to the cap ring, and having a shoulder which engages the cap ring to prevent unintended disassembly of the snap fit band from the cap ring;

(ii) a tamper evident band depending from the snap fit band and having a weakened area adjacent the cap ring comprising a plurality of perforations, such that the tamper evident ring is frangibly disconnected from the closure in one piece when the closure is removed from a container; and (iii) at least three tabs molded in a direction radially inwardly for engagement with an annular retaining bead on a container.

2. A closure according to claim 1, wherein the perforations are molded in the tamper evident band.

3. A closure according to claim 1, wherein the perforations are formed by a cutting operation subsequent to formation of the tamper evident band.

4. A closure according to claim 1 further comprising a plurality of bridges in the weakened area which are molded in the tamper evident band.

5. A closure according to claim 1 further comprising a plurality of bridges in the weakened area which are formed by a cutting operation subsequent to formation of the tamper evident band.

6. A closure according to claim 1, wherein the cap and the snap fit ring are made of plastic.

7. A closure according to claim 1, wherein the snap fit ring engages the cap ring on three sides of the cap ring to secure the snap fit ring to the cap.

* * * * *